United States Patent [19]

Misinchuk

[11] 4,163,965

[45] Aug. 7, 1979

[54] ELECTRICAL DIMMER PLUG

[76] Inventor: Peter D. Misinchuk, 15 Ballantyne Ct., Islington, Ontario, Canada, M9A 1W8

[21] Appl. No.: 920,727

[22] Filed: Jun. 30, 1978

Related U.S. Application Data

[63] Continuation of Ser. No. 763,651, Jan. 28, 1977, abandoned.

[51] Int. Cl.[2] ..... H01C 13/00

[52] U.S. Cl. ..... 338/220; 315/291; 338/221

[58] Field of Search ..... 338/220, 221; 361/331, 361/332, 357, 380; 200/51 R; 315/194, 291

[56] References Cited

U.S. PATENT DOCUMENTS

| | | | |
|---|---|---|---|
| 2,840,765 | 6/1958 | Carpenter | 315/291 |
| 3,935,505 | 1/1976 | Spiteri | 315/194 |

FOREIGN PATENT DOCUMENTS

| | | | |
|---|---|---|---|
| 506760 | 9/1930 | Fed. Rep. of Germany | 338/220 |
| 514750 | 11/1939 | United Kingdom | 338/220 |

*Primary Examiner*—C. L. Albritton

*Attorney, Agent, or Firm*—Daniel Jay Tick

[57] ABSTRACT

An electrical connector device for connecting a plurality of electrical fixtures to a wall outlet includes a dimmer device for manually varying the current supplied to appliances connected thereto.

1 Claim, 8 Drawing Figures

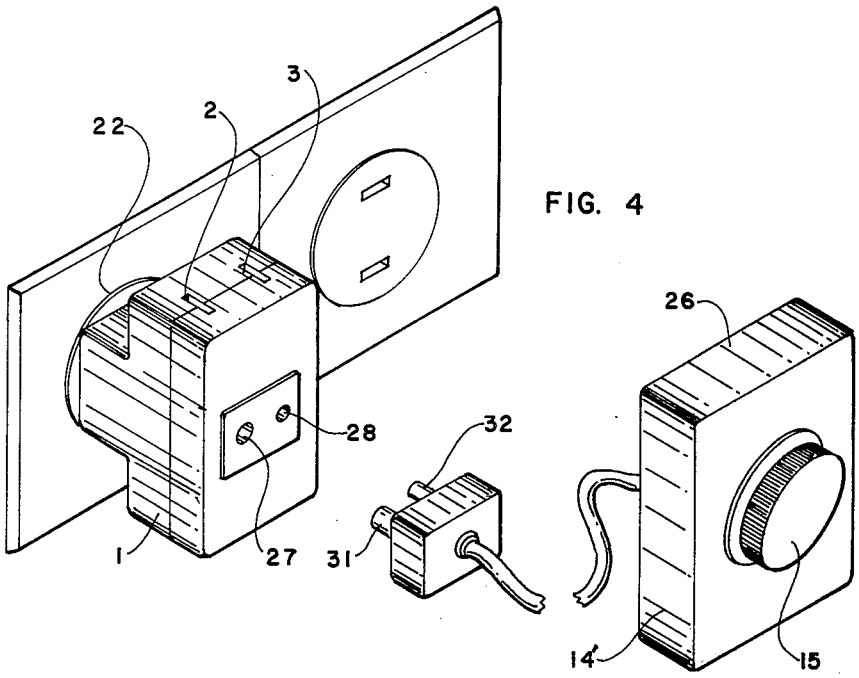
FIG. 4
FIG. 5
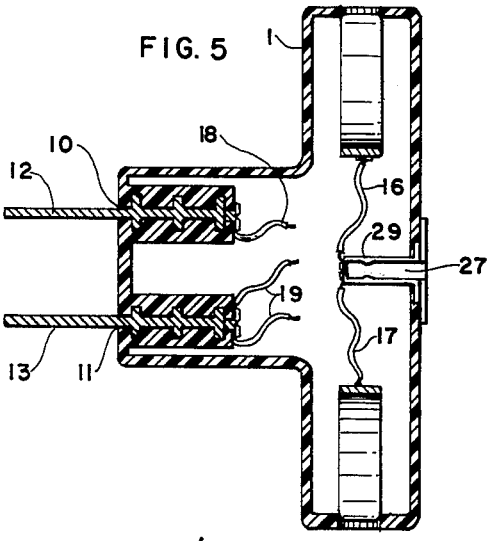
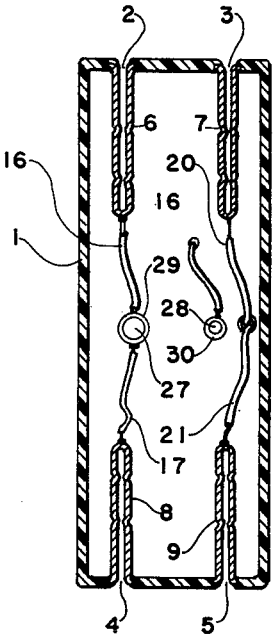
FIG. 6
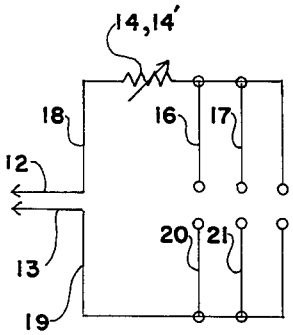
FIG. 8
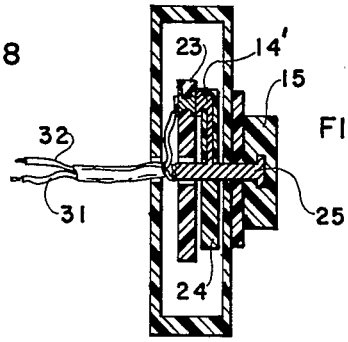
FIG. 7

ELECTRICAL DIMMER PLUG

This is a continuation of application Ser. No. 763,651, filed Jan. 28, 1977, abandoned.

BACKGROUND OF THE INVENTION

The present invention relates to an electrical dimmer plug.

Objects of the invention are to provide an electrical dimmer plug of simple structure, which is inexpensive in manufacture, used with facility, convenience and complete safety, and functions efficiently, effectively and reliably to selectively dim one or a plurality of electrical fixtures simultaneously, thereby avoiding the expense of individual switching devices or dimmers for each fixture.

BRIEF DESCRIPTION OF THE DRAWINGS:

In order that the invention may be readily carried into effect, it will now be described with reference to the accompanying drawings, wherein:

FIG. 4 is a perspective view of another embodiment of the electrical dimmer plug of the invention;

FIG. 5 is a view, on an enlarged scale, partly in section, of the electrical connector part of the embodiment of FIG. 4;

FIG. 6 is a view, on an enlarged scale, partly in section, taken along a plane perpendicular to that of the view of FIG. 5, of the electrical connector part of the embodiment of FIG. 4;

FIG. 7 is a cross-sectional view, on an enlarged scale, of the dimmer part of the embodiment of FIG. 4; and FIG. 8 is a circuit diagram of the electrical dimmer plug of the invention.

DETAILED DESCRIPTION OF THE INVENTION

The electrical dimmer plug of the invention comprises a combination of an electrical connector device, a dimmer device and a circuit connecting the dimmer device in the electrical connector device.

Figure 1:
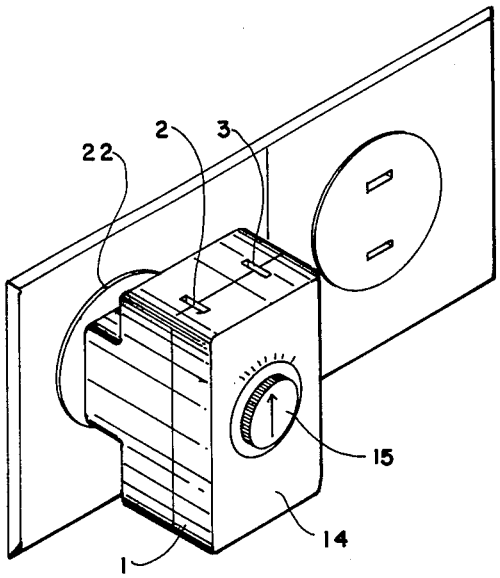
FIG. 1 is a perspective view of an embodiment of the electrical dimmer plug of the invention.

The electrical connector device of each of the embodiments of FIGS. 1 and 4 has a housing 1 (FIGS. 1 to 6) of electrically insulative material of any suitable known type such as, for example, Bakelite, hard rubber, or the like. The electrical connector device has at least first and second pairs 2 and 3, and 4 and 5 of spaced parallel slots formed therethrough (FIGS. 3 and 6). It may have as many as four spaced pairs of spaced parallel slots formed therethrough, or possibly more, for a larger unit. The first and second pairs of slots 2 and 3, and 4 and 5 accommodate the electrically conductive prongs of electrical connector plugs of electrical appliances such as, for example, lamps. Electrically conductive terminals 6 and 7, and 8 and 9 are provided at the slots 2 and 3, and 4 and 5, respectively, in the housing 1 for electrically contacting the electrical connector plugs inserted in said slots (FIGS. 3 and 6).

Figure 2:
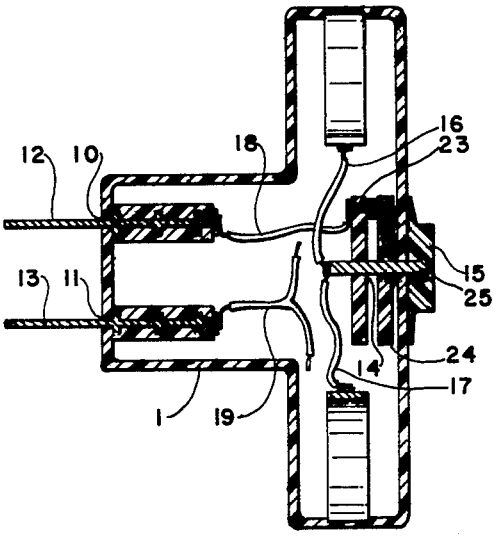
FIG. 2 is a view, on an enlarged scale, partly in section, of the embodiment of FIG. 1.
Figure 3:
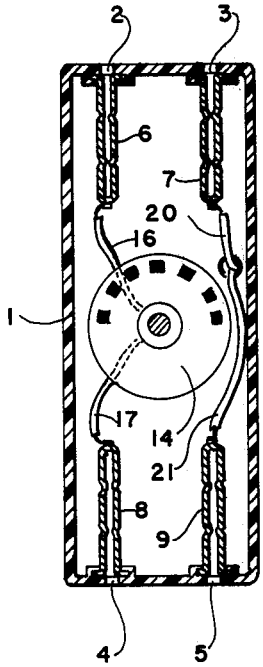
FIG. 3 is a view, on an enlarged scale, partly in section, taken along a plane perpendicular to that of the view of FIG. 2, of the embodiment of FIG. 1.

The housing 1 has a third pair of spaced parallel slots 10 and 11 formed therethrough, as shown in FIGS. 2 and 5. A pair of electrically conductive prongs 12 and 13 (FIGS. 2, 5 and 8) extend through the second pair of slots 10 and 11 with part thereof inside the housing and part outside the housing, as shown in FIGS. 2 and 5.

In accordance with the invention, a dimmer device 14 (FIGS. 1 to 3) or 14' (FIGS. 4 and 7) comprises a manually variable electrical resistance. The resistance is varied by manual rotation of a knurled knob 15 (FIGS. 1, 2, 4 and 7).

A circuit device has a plurality of electrical conductors 16, 17, 18, 19, 20, 21 in the housing 1 electrically connecting the terminals 6 and 7, and 8 and 9, and so on, the prongs 12 and 13 and the dimmer device 14 or 14' in circuit (FIGS. 2, 3, 5, 6 and 8) in a manner whereby when the prongs 12 and 13 are placed in electrical contact with a source of electrical energy via a wall outlet 22 (FIGS. 1 and 4), a current supplied by the source of electrical energy is supplied to the terminals 6 and 7, 8 and 9, and so on, via said dimmer device. Thus, the current supplied to the terminals 6 and 7, 8 and 9, and so on, is manually variable via the dimmer device 14 or 14'.

In the embodiment of FIGS. 1 to 3, the dimmer device 14 comprises a manually variable electrical resistance 23 in the housing 1 having the manual dial 15 outside the housing coupled to said resistance in the housing via a bore through the housing (FIG. 2). More particularly, the manual rotation of the knob or dial 15 rotates an insulated disc 24 bearing an electrically conductive contact mounted on the shaft 25 of the knob and rotatable therewith, inside the housing (FIG. 2). The disc 24 functions as the variable contact for the resistance 23. Thus, when the knob is rotated in one direction, the electrical resistance connected in the circuit is increased and when the knob is rotated in the opposite direction the electrical resistance connected in the circuit is decreased. The greater the extent of the rotation of the knob, the greater the increase or decrease of the resistance.

In the embodiment of FIGS. 4 to 7, the dimmer device 14' is of the same structure as that of the embodiment of FIGS. 1 to 3, with the exception that the dimmer device is housed in a separate housing 26 which is independent from the housing 1. The dimmer device 14' comprises a pair of spaced parallel dimmer slots 27 and 28 (FIGS. 4 and 6) extending into the housing 1. A pair of electrically conductive jackets 29 and 30 are provided in the dimmer slots 27 and 28, respectively (FIG. 6).

As hereinbefore mentioned, the dimmer device 14' is provided in an independent housing 26 and constitutes an independent manually variable electrical resistance unit which functions in the same manner as described with reference to FIG. 2. The variable resistance or dimmer device 14' thus has the same components as the variable resistance or dimmer device 14, so that FIGS. 2 and 7 disclose such components.

In the embodiment of FIGS. 4 to 7, a pair of electrically conductive dimmer prongs 31 and 32 (FIGS. 4 and 7) are insertable in the dimmer slots 27 and 28 and are electrically connected to the variable electrical resistance 23. The conductive jackets 29 and 30 are connected in circuit by the electrical conductors thereof. Thus, when the dimmer prongs 31 and 32 are inserted in the dimmer slots 27 and 28, respectively, the user selectively dims any appliances connected to the housing 1 via the slots 2 and 3, 4 and 5, and so on, thereof, by remote control, and need not be at the housing 1 in order to do so.

While the invention has been described by means of specific examples and in specific embodiments I do not wish to be limited thereto, for obvious modifications will occur to those skilled in the art without departing from the spirit and scope of the invention.

I claim:

1. In combination, an electrical connector device having a first housing of electrically insulative material having a plurality of spaced pairs of spaced parallel slots formed therethrough for accommodating the electrically conductive prongs of a plurality of electrical connector plugs inserted in the slots, electrically conductive terminals at all the slots in the housing for electrically contacting the prongs of electrical connector plugs inserted in the slots, and a pair of electrically conductive primary prongs extending through one of the pair of slots with parts thereof inside the housing and parts thereof outside the housing;

an additional housing;

dimmer means comprising a pair of spaced parallel dimmer slots extending into the first housing, a pair of electrically conductive jackets in the dimmer slots, an independent manually variable electrical resistance unit in the additional housing and a pair of electrically conductive dimmer prongs insertable in the dimmer slots and electrically connected to the variable electrical resistance unit and extending from said additional housing, said additional housing having a manual dial outside the housing and coupled to the independent manually variable electrical resistance in the additional housing via a bore through the housing; and circuit means having electrical conductors in the first housing electrically connecting the terminals of all the slots, the prongs and the electrically conductive jackets of the dimmer means in circuit in a manner whereby when said primary prongs are placed in electrical contact with a source of electrical energy, current supplied by the source of electrical energy is supplied to all of said terminals via said dimmer means whereby the current supplied to said terminals is manually variable via said dimmer means.

* * * * *